US012716327B2

(12) United States Patent
Ferreira Da Silva et al.

(10) Patent No.: US 12,716,327 B2
(45) Date of Patent: Aug. 25, 2026

(54) ELECTRIC VALVE FOR CONTROLLING THE SCALING OF CONTROL DEVICES IN A PRODUCTION STRING IN A WELL AND A METHOD FOR CONTROLLING THE SCALING USING SAID ELECTRIC VALVE

(71) Applicant: PETRÓLEO BRASILEIRO S.A.—PETROBRAS, Rio de Janeiro (BR)

(72) Inventors: Mario Germino Ferreira Da Silva, Rio de Janeiro (BR); Leonardo Osorio Pelisoli, Rio de Janeiro (BR); Roberto Motta Gomes, Rio de Janeiro (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 19/048,219

(22) Filed: Feb. 7, 2025

(65) Prior Publication Data

US 2025/0270899 A1 Aug. 28, 2025

(30) Foreign Application Priority Data

Feb. 22, 2024 (BR) ..... 1020240035208

(51) Int. Cl.
*E21B 37/06* (2006.01)
*E21B 34/06* (2006.01)

(52) U.S. Cl.
CPC ..... *E21B 37/06* (2013.01); *E21B 34/066* (2013.01)

(58) Field of Classification Search
CPC ..... E21B 43/12
See application file for complete search history.

(56) References Cited

U.S. PATENT DOCUMENTS 6,497,290 B1 * 12/2002 Misselbrook ..... E21B 49/08 166/77.2
2021/0324708 A1 * 10/2021 Candido Gomes ..... E21B 43/12

* cited by examiner

*Primary Examiner* — William D Hutton, Jr.
*Assistant Examiner* — Avi T Skaist
(74) *Attorney, Agent, or Firm* — Kilpatrick Townsend & Stockton LLP

(57) ABSTRACT

The present invention discloses an electric valve (100) for controlling the scaling of control devices (200) in a production string (300) in a well, comprising an electric cable (10), an electric motor (20) connected to the electric cable (10) and a communication orifice (30) comprising an inner sleeve (31). Furthermore, there is disclosed a method for controlling the scaling of control devices (200) in a production string (300) in a well using said electric valve (100).

12 Claims, 3 Drawing Sheets

ELECTRIC VALVE FOR CONTROLLING THE SCALING OF CONTROL DEVICES IN A PRODUCTION STRING IN A WELL AND A METHOD FOR CONTROLLING THE SCALING USING SAID ELECTRIC VALVE

CROSS-REFERENCES TO RELATED APPLICATIONS

This application claims the benefit of priority to Brazilian Patent No. BR 1020240035208 filed Feb. 22, 2024, the contents of which are hereby incorporated by reference in their entirety for all purposes.

FIELD OF THE INVENTION

The present invention relates to the technical field of drilling, well completion, and lifting and flow technologies. More specifically, the present invention relates to an electric valve for controlling the scaling of control devices in a production string in a well and a method for controlling the scaling and using said electric valve.

BACKGROUNDS OF THE INVENTION

The production losses associated with scaling are already known to the oil industry. They are a challenge for the oil industry, as they generate production loss and high costs to mitigate the problem.

Control devices (ICDs, AICDs and others) for gas-oil ratio (GOR) and water and sediment content (Basic Sediment and Water—BSW) generally operate by applying a pressure drop that varies according to the arrival of the fluid that must be controlled; therefore, it is desirable that this initial pressure drop be minimized so that oil production is not penalized, but at the same time the pressure drop must increase considerably at the time of the arrival of the gas or water so that the production of the undesirable fluid is controlled.

However, these same mechanisms will act as traps for scale deposits; so over time, the pressure drop devices, regardless of the model or manufacturer, will be filled with scales and will lose their functionality.

For example, AICDs (Autonomous Inflow Control Device) have as their main feature the ability to "autonomously" restrict the flow rate based on the properties of the fluid that is passing through the valve. That is, it increases the restriction on the flow of gas or water, when compared to the flow of oil. This increased restriction on the flow (pressure drop) creates an environment conducive to the formation of scales.

Such scales lead to the partial or total blockage of the AICD valve and, consequently, to the loss of oil production associated with the scales, as well as the need to stop the production to carry out chemical removal treatments, which will generate revenue losses due to the stoppage of production and costs associated with the use of critical resources such as completion rigs and stimulation vessels.

Therefore, there is a need for progress in the solutions for controlling scale in control devices in a production string in a well with reduced impacts on oil production.

STATE OF THE ART

The state of the art includes the disclosure of some documents that contain teachings regarding valves and systems associated with control devices in a production string in a well.

Document BR1120140072450 discloses wellbore flow control devices and their use in the production of a fluid from a subterrain formation and, more specifically, in the coupling of flow regulation assemblies for better control of fluid access to the interior of a wellbore piping.

Document Ouronova-eICV-Electric Inflow Control Valve, available on the website https://ouronova.com/eicv-electric-inflow-control-valve/discloses an electric inflow control valve that comprises an infinitely variable choke. Said electric inflow control valve provides a sophisticated flow production profile that allows for optimal production and injection control of each zone in the reservoir.

Document BR1120150132588 discloses a production sleeve assembly for use in a wellbore comprising a wellbore tubular, a plurality of fluid paths configured to provide fluid communication within the downhole component, a plurality of electronic actuators configured to selectively provide fluid communication through one or more of the plurality of fluid paths, and at least one sensor coupled to the plurality of electronic actuators. One or more of the plurality of electronic actuators are configured to selectively actuate to permit or prevent the fluid flow through a corresponding fluid path of the plurality of fluid paths in response to the at least one sensor receiving a suitable signal.

Document EP3527776B1 discloses a wireless actuation system comprising a transmitter, an actuation system comprising a receiving antenna, and one or more transitional sliding members from a first position to a second position. The transmitter is configured to transmit an electromagnetic signal, and the sliding member prevents a fluid communication path through one or more ports of a housing when the sliding member is in the first position. The sliding member allows the fluid communication through one or more orifices of the housing when the sliding member is in the second position.

The document Oil Field Technology, Volume 10, Issue 11, 2017, p. 27, reports the problem of scaling in AICD type valves, through the use of bypass valves, without providing further details on how the problem is solved with a bypass valve, citing two possible installations: as a separate subsea system or as part of the screen installed in the completion, but also without giving further information on the operation or features of the valve.

The paper by Vimolsubsin, Pojana, Wasanapradit, Tawan and Thanudcha Khunmek. "Cost-Effective Adaptive Inflow Technology for Sand Prevention in an Injection Well." Paper presented at the Abu Dhabi International Petroleum Exhibition and Conference, Abu Dhabi, United Arab Emirates, November 2020, describes the use of AICD valves for wells in the Gulf of Thailand, where there is a major problem of sand formation in depleted reservoirs, which occurs due to the injection of water into the wells to maintain their production. Although the paper mentions that AICD bypass valves were used, in reality only AICD valves were used and no bypass valve related to AICD itself. Furthermore, it is worth mentioning that the paper refers to sand production, due to the injection of water to maintain oil production.

The paper by G. M. Graham; N. Goodwin; E. Albino; H. Guan; H. L. Pinto; M. C. Bezzera. Minimizing Scale Deposition Through Surface Enhancement in Downhole Tools. SPE International Oilfield Scale Conference and Exhibition. SPE-169781-MS. 2014, discloses the use of flow control valves and flow control devices, focusing on carbonate scaling in deep waters. An important conclusion of the work is that ICV or AICV type valves can lead to scale formation. Thus, the document describes precisely the problem that the proposed invention aims to solve.

The document TAQA-FloSure Bypass Valve. Effective treatments in AICD wells, available on the website https://tq.com/wp-content/uploads/2023/10/FloSure-Autonomous-ICD-Datasheet-2019.pdf, discloses a commercial autonomous inflow control device (AICD) called "FloSure", which is reported to be an effective solution for increasing the oil production throughout the life of the field. The device must be placed inside the AICD valve.

Nevertheless, deficiencies remain in the state of the art. With this in mind, the features and advantages of the present invention will clearly emerge from the detailed description below and with reference to the attached drawings, which are provided only as preferred and non-limiting embodiments.

BRIEF DESCRIPTION OF THE INVENTION

The present invention discloses an electric valve (100) for controlling the scaling of control devices (200) in a production string (300) in a well, comprising an electric cable (10), an electric motor (20) connected to the electric cable (10) and a communication orifice (30) comprising an inner sleeve (31). Furthermore, there is disclosed a method for controlling the scaling of control devices (200) in a production string (300) in a well using said electric valve (100).

BRIEF DESCRIPTION OF THE FIGURES

In order to complement the present description and obtain a better understanding of the features of the present invention, figures are presented, where in an exemplary and non-limiting manner, preferred embodiments thereof are represented.

DETAILED DESCRIPTION OF THE INVENTION

Figure 1:
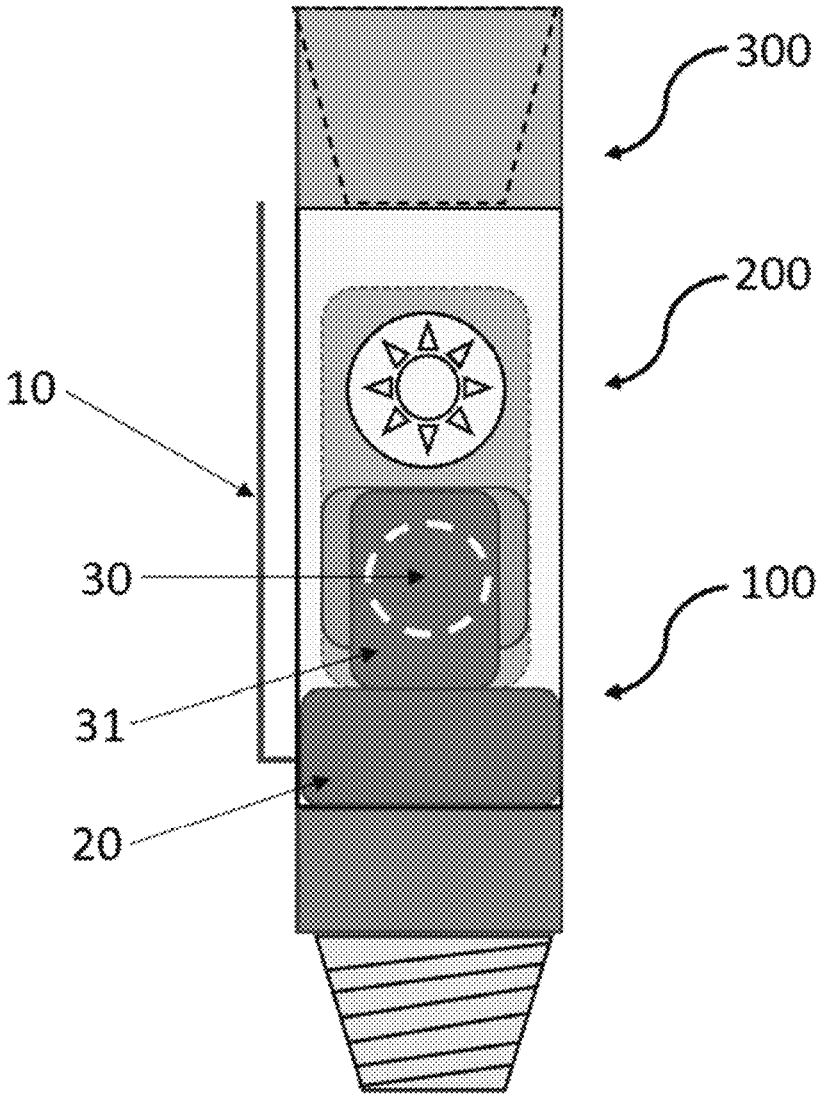
FIG. 1 illustrates an electric valve for scaling control in a closed configuration.

The present invention relates to an electric valve (100) for scaling control of control devices (200) in a production string (300) in a well. Said electric valve (100) seeks to facilitate the reservoir management by maintaining production in wells equipped with GOR and BSW control devices (ICDs, AICDs and others) in the production string.

The electric valve (100) is installed in a production string of a well during the well completion. Eventually, when a blockage event (partial or total) of a flow control device (such as an ICD or AICD) occurs due to scaling and thus generates a loss of production in the well, the valve (100) will be activated to open a communication orifice, which will allow the production to return to normal levels, without the loss of production caused by the blockage of the flow control device due to scales.

It will be appreciated that respective electric valves (100) for scale control can be used for each of the intervals of a well, so that the scale control can be performed for respective control devices (200) in a production string (300).

In this sense, an electric valve (100) for scale control advantageously allows, at least:

Diverting the flow of the GOR and BSW control devices (ICDs, AICDs and others), when these devices are blocked by scale;

Maintaining the production flow rate of the well;

Performing a chemical treatment to remove scale from GOR and BSW control devices (ICDs, AICDs and others) according to the blockage situation. For example, acids such as hydrochloric, acetic and/or formic acid can be used for calcium carbonate scales in pre-salt wells. Alternatively, the diethylenetriamine pentaacetic acid (DTPA) can be used for barium sulfate, strontium sulfate and calcium sulfate scales; and After removing the scale from the GOR and BSW control devices (ICDs, AICDs and others), the electric valve (100) for scale control can be closed to allow the oil production flow to pass through the control devices again and thus, the return of GOR and/or BSW control to the well.

Therefore, the electric valve (100) for controlling the scaling of control devices (200) allows avoiding the financial losses associated with production losses in wells after well obstructions, as well as operating costs with the use of completion rigs and/or stimulation vessels to remove the scales formed in these GOR and BSW control devices (ICDs, AICDs and others), and thus mitigate the production losses.

The operation of the electric valve (100) may be performed outside a well, a production platform or a production unit, which will have electrical actuation control of the electric valve (100) to unclog the BSW and/or GOR control devices (ICD, AICD and others) and maintain the production flow.

There are shown in Table 1 the operating parameters of the electric scale control valve, that is, temperature in degrees Celsius, pressure in pounds per square inch, flow rate in cubic meters per hour, the metallurgy, which was selected to withstand acid treatment operations, the operating force, the closing time range in hours and the actuation position, which will be performed through an umbilical actuated by the SPU.

TABLE 1

| Parameter | Value |
|---|---|
| Temperature (° C.) | 60-90 |
| Pressure (psi) [MPa] | 5,000 to 10,000 [34.47 to 68.95] |
| Flow rate ($m^3$/h) | 500 to 3,000 |
| Valve material | Super chrome 13 |
| Force (klbf) [kN] | 15 [147.1] |
| Closing time (h) | 1 to 2 |
| Actuation at SPU | Via umbilical |

Preferred Embodiments

Figure 2:
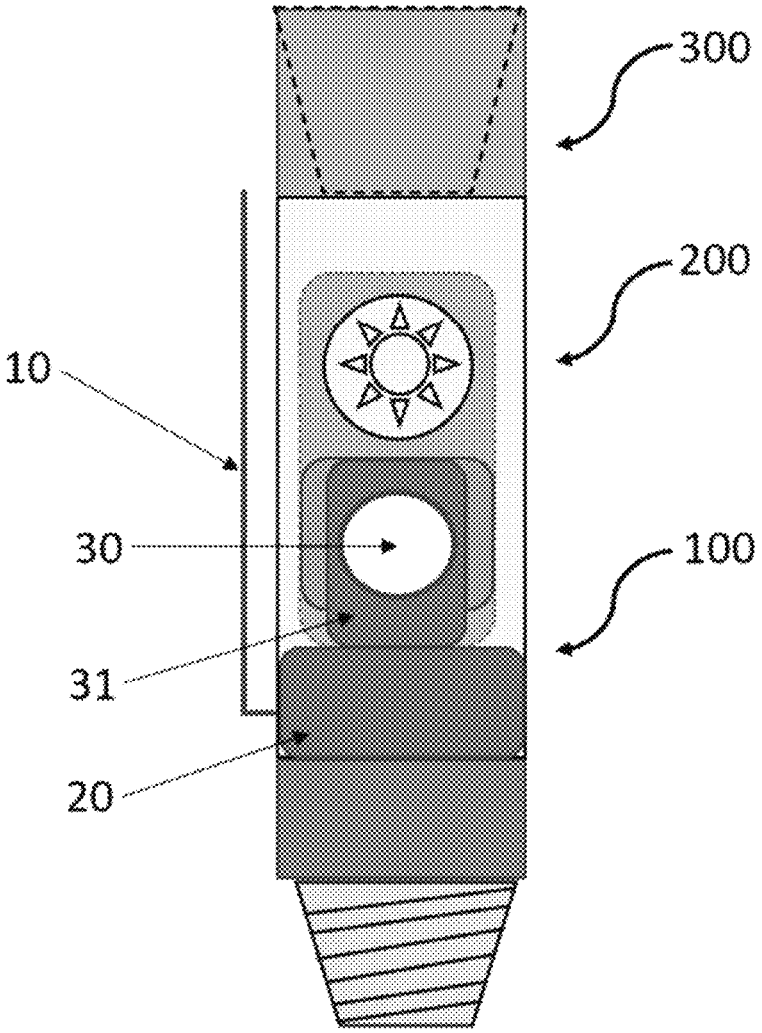
FIG. 2 illustrates an electric valve for scaling control in an open configuration.

A preferred embodiment of the electric valve (100) for scale control, as illustrated in FIGS. 1 and 2, comprises: an electric cable (10), an electric motor (20) connected to the electric cable (10), and a communication orifice (30) comprising an inner sleeve (31).

The electric valve (100) can be arranged above or below the control devices (200), preferably being arranged below the same. An electric valve (100) can be used in conjunction with each control device of respective production intervals of the well.

Energizing the electric cable (10) activates the electric motor (20) to perform a displacement of the inner sleeve (31) to open or close the communication orifice (30), and in which said opening of the communication orifice (30) fluidly connects an annulus of the well to the production string (300). In this sense, the communication orifice (30) can be a bypass or contour, normally closed.

The electric motor (20) displaces the inner sleeve (31). The inner sleeve (31) can be displaced by means of a ratchet type fitting mechanism designed on the inner edge of the sleeve and which will be moved by mini shaft-shaped ratchets that will be positioned on the inside of the valve, designed to transmit the force of the electric motor to promote the movement of the inner sleeve (31) of the valve (100) in the upward or downward direction, according to the command sent via the umbilical.

Accordingly, with the bypass of the production flow of the well's flow control device through the opening of the communication orifice (30) of the electric valve (100), the well can return to normal production levels, without the loss of production caused by the blockage of the flow control device due to scales.

The opening of the communication orifice (30) may also be called a bypass means or a contour means. As can be inferred from the above description, said component has the function of diverting part of the fluid flow around a flow control device, in this case the flow control device, instead of passing through the same. This flow tapping is created by opening or closing the communication orifice (30) of the electric valve (100).

The communication (30) has the orifice advantages of controlling or regulating the production flow, without completely interrupting said flow. This may be necessary for maintenance, repair, adjustments or to prevent damage to the flow control device.

It will be appreciated that the communication orifice (30), in addition to the open and closed states, may comprise a plurality of intermediate states, allowing a fine adjustment to direct a specific amount of production flow around the flow control device, allowing the remainder of the fluid to pass normally. In addition, it can be used to control the pressure or flow rate in a system, providing an alternative path for the flow.

Figure 3:
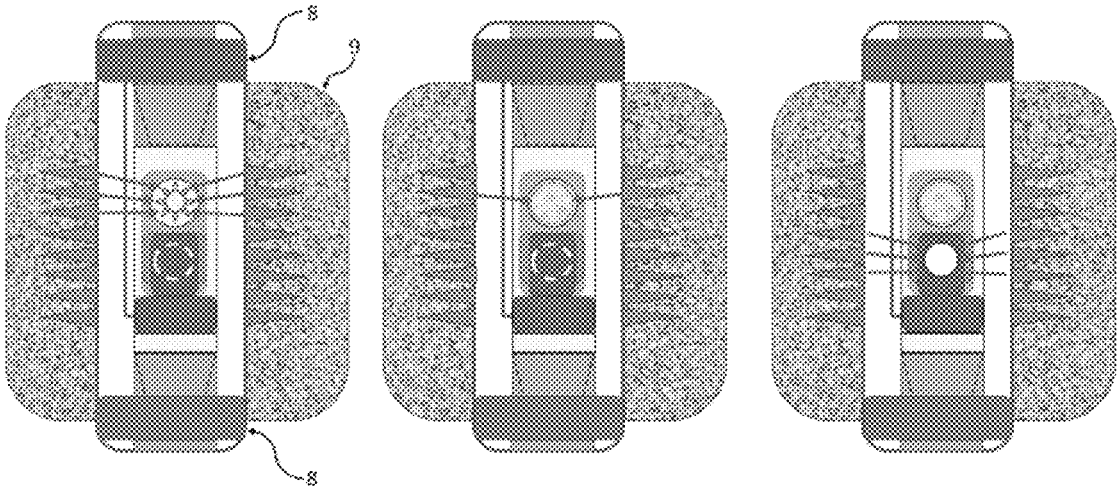
FIG. 3 illustrates an operating sequence of the electric valve for scaling control in an exemplary interval of a production well.

Therefore, by way of example, and not as a limitation, an operating sequence of the electric valve (100) for controlling the scaling in an exemplary interval between packers (8) of a production well, as illustrated in FIG. 3, comprises:

allowing a production flow (oil) from a reservoir (9) to a production string (300) from perforated paths of an annulus of the well through a flow control device (200); identifying a blockage due to scaling of the flow control device (200);

opening a communication orifice (30) of the electric valve (100), by means of the displacement of an inner sleeve (31) driven by an electric motor (20) energized by an electric cable (10), to fluidly connect the annulus of the well to the production string (300) through said opening of the communication orifice (30).

Implementation Example

In an implementation example of the electric valve (100) for scale control, the following combinations or production steps of a well equipped with GOR and BSW control devices (ICDs, AICDs and others) can be implemented:

Initially, when the GOR and BSW control devices (ICDs, AICDs and others) are installed in the well, but the well does not yet produce with BSW (Basic Sediments and Water) and/or GOR (Oil Gas Ratio), the inner sleeve (31) of the electric valve (100) for scale control can be installed open, allowing a full flow through the communication orifice (30).

When the gas (GOR) and/or water (BSW) productions begin, and these reach a value range (for example, 5% for GOR and, for example, 5% for BSW) that compromises the efficiency of the well's production, then the sleeve (31) can be closed and the production flow directed to pass through the GOR and BSW control devices (ICDs, AICDs and others), in order to control the production of water (BSW) and/or gas (GOR).

If scaling forms in the GOR and BSW control devices (ICDs, AICDs and others), which leads to a production blockage and consequently a loss of production, then at this moment the inner sleeve (31) will be activated to the open position of the electric valve (100) to control scaling, returning the flow through the communication hole (30) of the production sleeve (31).

At this point, if desired, a chemical treatment of the BSW and/or GOR control devices (ICD, AICD and others) can be carried out, through the electric valve (100) for scale control, via a stationary production unit (SPU), for example with organic acids (acetic and/or formic acids) and/or minerals such as HCl, to remove the calcium carbonate scale, for the wells in the pre-salt fields.

Once the calcium carbonate scale has been removed from the BSW and/or GOR control devices (ICD, AICD and others), then the sleeve (31) can be returned to the closed position and return the production flow to be carried out by the BSW and/or GOR control devices (ICD, AICD and others), and, thus, return to controlling the GOR and/or BSW through the BSW and/or GOR control devices (ICD, AICD and others).

In this way, even if one or more of the BSW and/or GOR control devices (ICD, AICD and others) become blocked due to the formation of scale in the body of the BSW and/or GOR control devices (ICD, AICD and others), from the obstruction in the GOR and BSW control devices (ICDs, AICDS and others), compromising even the operating mechanism of these devices, it will be possible to activate the electric valve (100) to control scale and, through the activation of an electric motor (20), open a bypass for the passage of the well's production flow through the same.

Those skilled in the art will value the knowledge presented herein and will be able to reproduce the invention in the presented embodiments and in other variants, encompassed by the scope of the attached claims.

The invention claimed is:

1. An electric valve for controlling scaling of control devices in a production string in a well, comprising:

an electric cable;

an electric motor connected to the electric cable; and a communication structure defining an orifice and comprising an inner sleeve, wherein the inner sleeve is electrically coupled to the electric motor via the electric cable such that energization of the electric cable is configured to:

drive the electric motor to actuate a displacement of the inner sleeve between an open position, wherein:

the orifice is at least partially uncovered by the inner sleeve to fluidly connect an annulus of the well to the production string, or a closed position; and the orifice is covered by the inner sleeve such that the inner sleeve prevents fluid communication between the annulus and the production string; and move the inner sleeve to open or close the communication structure through a ratchet mechanism, wherein the ratchet mechanism includes one or more shaft-shaped ratchets positioned inside the electric valve.

2. The electric valve according to claim 1, wherein the electric cable comes from outside a well, a production platform or a production unit.

3. The electric valve according to claim 1, wherein the electric motor can perform the displacement of the inner sleeve in an upward or downward direction through a fitting mechanism.

4. The electric valve according to claim 1, wherein the communication structure comprises a bypass passage that is in a closed state when the electric motor is not energized.

5. The electric valve according to claim 1, comprised by being arranged above or below the control devices.

6. The electric valve-according to claim 1, wherein one electric valve is used per production interval of the well.

7. The electric valve according to claim 1, wherein energization of the electric cable is configured to linearly move the inner sleeve to open or close the communication structure.

8. The electric valve according to claim 1, wherein energization of the electric cable is configured to move the inner sleeve to open or close the communication structure through a ratchet mechanism.

9. The electric valve according to claim 1, wherein:

in the open position, the communication structure diverts at least a portion of production flow around at least one of the control devices; and in the closed position, production flow is directed to pass through the control devices.

10. A method for controlling the scaling of control devices in a production string in a well using an electric valve as defined in claim 1, comprising the steps of:

allowing a production flow from a reservoir to a production string from perforated paths of an annulus of the well, through a flow control device;

identifying a blockage due to scaling of the flow control device;

opening a communication orifice of the electric valve, by means of the displacement of an inner sleeve driven by an electric motor energized by an electric cable, to fluidly connect the annulus of the well to the production string through said opening of the communication orifice.

11. The method according to claim 10, further comprising the step of:

performing a chemical treatment of the control devices to remove the scaling.

12. The method according to claim 10, further comprising the step of:

after removing the scaling from the control devices, returning the sleeve to the closed position and returning the production flow to be carried out through the control devices.

* * * * *